US012649086B2

(12) United States Patent
Splichal

(10) Patent No.: US 12,649,086 B2
(45) Date of Patent: Jun. 9, 2026

(54) DUAL SENSORY BALANCE BOARD AND METHODS OF USE THEREOF

(71) Applicant: Naboso Technology, Inc., Chandler, AZ (US)

(72) Inventor: Emily Splichal, Chandler, AZ (US)

(73) Assignee: Naboso Technology, Inc., Chandler, AZ (US)

( * ) Notice: Subject to any disclaimer, the term of this patent is extended or adjusted under 35 U.S.C. 154(b) by 49 days.

(21) Appl. No.: 18/591,701

(22) Filed: Feb. 29, 2024

(65) Prior Publication Data

US 2025/0276212 A1 Sep. 4, 2025

(51) Int. Cl.
*A63B 22/16* (2006.01)

(52) U.S. Cl.
CPC ..... *A63B 22/16* (2013.01)

(58) Field of Classification Search
CPC ..... A63B 22/16; A63B 23/08; A61H 15/00; A43B 7/14; A43B 3/24
See application file for complete search history.

(56) References Cited

U.S. PATENT DOCUMENTS 2,253,996 A * 8/1941 Bechman ..... A63B 22/16 482/146
4,759,542 A * 7/1988 Hudec ..... A63B 22/16 482/146
5,368,535 A 11/1994 Twardokens
5,441,466 A 8/1995 Piaget et al.
5,584,787 A 12/1996 Guidry
5,643,154 A 7/1997 Awbrey et al.
5,643,164 A 7/1997 Teff
6,616,583 B1 9/2003 Stack
6,666,797 B1 * 12/2003 Martin ..... A63B 69/0093 482/146
6,811,523 B1 11/2004 Kirk
6,916,276 B1 * 7/2005 Robinson ..... A63B 69/0093 482/80
D513,774 S 1/2006 Nudo
7,134,990 B2 11/2006 Wischusen
7,137,938 B2 11/2006 Gottlieb
D604,374 S 11/2009 Bizzell
7,625,294 B1 12/2009 Isaac et al.
(Continued)

FOREIGN PATENT DOCUMENTS

WO WO2015130177 A1 9/2015

OTHER PUBLICATIONS

US D1,007,615 S, 12/2023, Splichal (withdrawn)
(Continued)

*Primary Examiner* — Bryan Earles
(74) *Attorney, Agent, or Firm* — Womble Bond Dickinson (US) LLP

(57) ABSTRACT

A balance board including a platform and a first balance block. The platform having a top side and a bottom side that is opposite the top side. The platform is sized and dimensioned to receive a single foot of a user thereon. The top side of the platform may include a mechanoreception stimulation surface that is configured to mechanoreceptively stimulate neurons within the cutaneous skin of the user. The first balance block is removably attached to the bottom side of the platform. The first balance block that is configured to proprioceptively stimulate neurons within muscles, tendons, or joints of the user.

23 Claims, 11 Drawing Sheets

(56) References Cited

U.S. PATENT DOCUMENTS

| | | | | |
|---|---|---|---|---|
| 7,775,952 | B1 | 8/2010 | Curran | |
| 8,574,138 | B2 | 11/2013 | Geotsalitis | |
| D730,456 | S | 5/2015 | Mahoney et al. | |
| 9,079,072 | B2 | 7/2015 | Agostini | |
| D746,386 | S | 12/2015 | Mahoney et al. | |
| 9,259,616 | B2 | 2/2016 | Carr | |
| 9,446,288 | B1 | 9/2016 | Pazan | |
| D785,731 | S | 5/2017 | Slack | |
| 10,159,372 | B2 * | 12/2018 | Heath | A63B 22/18 |
| 11,161,013 | B2 * | 11/2021 | Klopman | A63B 23/0458 |
| D942,565 | S * | 2/2022 | Hu | D21/688 |
| 11,642,279 | B2 | 5/2023 | Splichal | |
| D1,003,446 | S | 10/2023 | Splichal | |
| 12,005,306 | B2 * | 6/2024 | Hogan | A63B 22/16 |
| 12,115,410 | B2 * | 10/2024 | Lagioia | A63B 21/068 |
| 2001/0006926 | A1 | 7/2001 | Schwickrath | |
| 2003/0225348 | A1 * | 12/2003 | Chen | A63B 22/16 601/28 |
| 2005/0245363 | A1 | 11/2005 | Shumrick | |
| 2008/0020856 | A1 | 1/2008 | Rosa | |
| 2008/0242521 | A1 | 10/2008 | Einav | |
| 2009/0197748 | A1 | 8/2009 | Smith | |
| 2010/0285941 | A1 | 11/2010 | VanBuren | |
| 2011/0256983 | A1 | 10/2011 | Malack et al. | |
| 2012/0088642 | A1 | 4/2012 | Kulzer | |
| 2012/0178068 | A1 * | 7/2012 | Breach | A43C 11/146 434/247 |
| 2013/0053228 | A1 * | 2/2013 | Winegar | A63B 22/16 482/146 |
| 2013/0310235 | A1 * | 11/2013 | Carr | A63B 21/022 482/145 |
| 2014/0371041 | A1 | 12/2014 | Terpstra et al. | |
| 2015/0133280 | A1 | 5/2015 | Maximillian et al. | |
| 2015/0238820 | A1 | 8/2015 | Langer et al. | |
| 2015/0321051 | A1 | 11/2015 | Olson | |
| 2016/0213301 | A1 | 7/2016 | Port | |
| 2017/0189742 | A1 * | 7/2017 | Mangum | A63B 21/4037 |
| 2018/0243166 | A1 | 8/2018 | Splichal | |
| 2020/0023239 | A1 | 1/2020 | Hwang | |
| 2021/0204650 | A1 * | 7/2021 | Meschter | A43B 13/122 |
| 2022/0133663 | A1 | 5/2022 | Splichal | |
| 2022/0134046 | A1 | 5/2022 | Splichal | |

OTHER PUBLICATIONS

Black Mountain Products Exercise Balance Stability Disc with Hand Pump, https://www.amazon.com/Black-Mountain-Balance-Disc-Green/dp/B01LROXLHA/ref=sr_1_5?crid=1GLS4G56PSWGL&keywords=black%2Bmountain%E2%80%A6&th=1, known at least as early as Feb. 2, 2024, 9 pgs.

International Search Report for PCT/IB2025/051894, dated Jun. 25, 2025, 14 pgs.

* cited by examiner

DUAL SENSORY BALANCE BOARD AND METHODS OF USE THEREOF

BACKGROUND

1. Technical Field

The present disclosure relates to fitness equipment and therapeutic devices and, more specifically, to balance or wobble boards to train and improve balance and locomotion.

2. Discussion of Related Art

Balance and ambulation are a complex relation between several biological systems such as the central nervous system (CNS), peripheral nervous system (PNS), and the skeletal muscle system. One aspect between these systems is proprioception, or the sense of self-movement. Proprioceptors in the muscles, tendons, and joints detect kinematic information about the limb, joint, or digit such as joint position, movement, or load. The proprioceptors share this kinematic information with the CNS where it is integrated with information from other sensory systems, e.g., the visual system and the vestibular system, to create a wholistic representation of body position, movement, and acceleration.

Balance or wobble boards have been used by physical therapists and athletes to improve balance and locomotion for both rehabilitative and performance purposes. Balance boards challenge the relationships between the central nervous system (CNS), peripheral nervous system (PNS), and the skeletal muscle system to train and improve balance and ambulation. Conventional balance boards often include a support surface and a rocking or wobbling base. A user stands on the support surface and the base is configured to be intentionally unstable beneath the user, forcing the user to actively balance on the balance board.

Separate devices may improve balance through mechanical stimuli to the bottoms of the feet. The soles of the feet contain mechanoreceptors within the cutaneous layer of skin that sense mechanical stimuli such as pressure, skin stretch, or texture. Such mechanical stimuli may increase local nerve activation and blood flow. Example devices for providing mechanical stimuli are described in U.S. Pat. No. 11,642,279, filed Sep. 22, 2020, and U.S. Patent Publication No. 20220134046, filed Jan. 14, 2022.

SUMMARY

This disclosure relates generally to a balance board that simultaneously stimulates both mechanoreceptors and proprioceptors of a user. The dual stimulation may enhance somatosensory stimulation and may further benefit balance training.

In an aspect of the present disclosure, a balance board includes a platform and first balance block. The platform has a top side and a bottom side opposite the top side. The platform is sized and dimensioned to receive a single foot of a user thereon. The top side of the platform includes a mechanoreception stimulation surface configured to mechanoreceptively stimulate neurons within cutaneous skin of the user. The first balance block is removably attached to the bottom side of the platform. The first balance block is configured to proprioceptive stimulate neurons within muscles, tendons, or joints of the user.

In aspects, the top side is configured to receive the single foot of the user in an unsecured manner. The mechanoreception stimulation surface may include a plurality of protuberances projecting away from the top side of the platform.

In some aspects, the first balance block is configured to micro-wobble under the weight of a user to proprioceptively stimulate neurons of the user. The first balance block may be configured to micro-wobble omnidirectionally around a perimeter thereof to improve balance of the user in each plane or axis of movement.

In certain aspects, the balance board includes a second balance block removably attached to the bottom side of the platform. The second balance block may be sized and dimensioned similar to the first balance block. The balance board may have a first configuration in which the first balance block is disposed adjacent to a first side end of the platform and the second balance block is disposed adjacent to a second side end of the platform opposite the first side end. The second balance block may be spaced apart from the first balance block. The balance board may have a second configuration in which the first balance block is spaced apart from the first side end and the second balance block is spaced apart from the second side end. The balance board may be configured to provide more proprioceptive stimulate when in the second configuration than in the first configuration.

In another aspect of the present disclosure, a balance board includes a platform and a first balance block. The platform has a textured first side and second side opposite the textured first side. The second side includes a first part of a two-part fastener. The platform is sized and dimensioned to receive a single foot of a user thereon, the textured first side is configured to mechanoreceptivley stimulate the user. The first balance block includes a second part of the two-part fastener. The first balance block is removably attached to the second side of the platform. The first balance block is configured to proprioceptively stimulate the user. The balance board is configured to improve balance of the user during locomotion.

In aspects, the textured first side comprises a plurality of protuberances projecting upwardly therefrom. The first balance block may be configured to deform under the weight of the user to proprioceptively stimulate neurons of the user. The first balance block may be configured to deform omnidirectionally around a perimeter thereof under the weight of the user to improve balance of the user in each plane or axis of movement. The balance board may be configured to improve balance of the user with the single foot of the user unsecured to the platform.

In some aspects, a balance trainer kit includes a balance board with a plurality of balance blocks. The balance blocks are attachable to the platform such that the balance board is configurable into a first configuration, a second configuration, and a third configuration and is composable into a first composition and a second composition.

In another aspect of the present disclosure, a balance board includes a platform having a top side and a bottom side opposite the top side. The top side includes a mechanoreception stimulation surface. The bottom side including a securement surface extending along a length of the bottom side between a first side end of the platform and a second side end opposite the first side end. The first balance block is removably attached to the bottom side of the platform and is positionable between the first side end and the second side end. The first balance block includes an attachment surface mateable with the securement surface to attach the first balance block to the platform.

In aspects, the balance block has a rectangular profile. The first balance block may have a height in the range of 10 millimeters to 60 millimeters. The first balance block may have a semi-circular profile. The securement surface may be a first part of a two-part fastener and the attachment surface may be a second part of the two-part fastener.

In some aspects, the balance board includes a second balance block removably attached to the bottom side of the platform and positionable between the first side end and the second side end. The balance board may have a first configuration in which the first balance block is disposed adjacent to the first side end and the second balance block is disposed adjacent to the second side end and spaced apart from the first balance block. The balance board may have a second configuration in which the first balance block is spaced apart from the first side end and the second balance block is spaced apart from the second side end.

In another aspect of the present disclosure, a method of assembling a balance board includes selecting a configuration and a composition for the balance board and attaching balance blocks to the platform. A configuration for the balance board is selected from one of a first configuration, a second configuration, or a third configuration. A composition for the balance board is selected from one of a first composition, a second composition, or a third composition. The balance blocks are attached to a platform of the balance board such that the balance board is in the selected configuration and has the selected composition.

In aspects, the method includes reconfiguring the balance board into a different configuration of the first configuration, the second configuration, or the third configuration. The method may include recomposing the balance board into a different composition of the first composition, the second composition, or the third composition.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
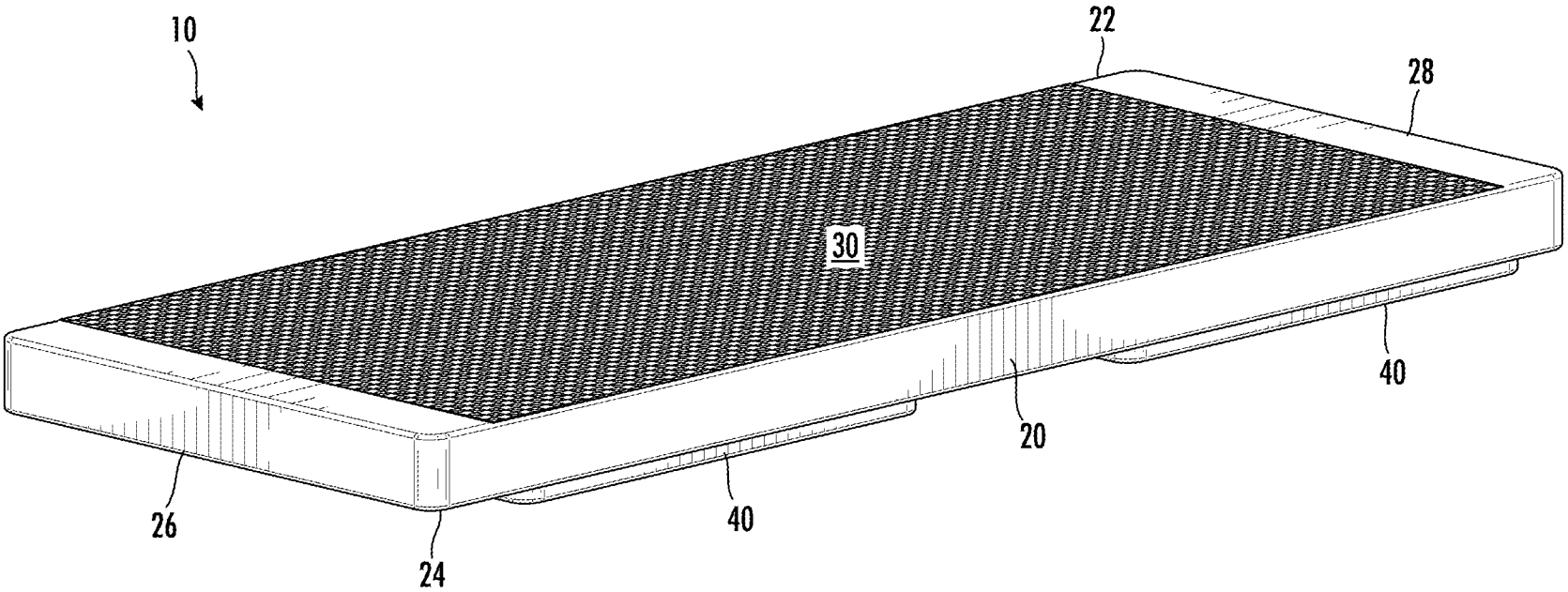
FIG. 1 is a perspective view of a balance board in accordance with embodiments of the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used herein, the term "locomotion" refers to natural or functional motion of humans such as walking or running. The term "proprioceptive stimulation" refers to activation of neurons within the muscles, tendons, ligaments, or joints of a user that sense kinematic parameters of a joint such as position, movement, or load. The term "mechanoreceptive stimulation" refers to activation of neurons within the dermis layer of skin of a user that sense mechanical pressure. The term "macro-circulation" refers to circulation of blood through the relatively large blood vessels of the circulatory system such as arteries and veins and the term "micro-circulation" refers to circulation of blood through the smallest blood vessels of the circulatory system such as arterioles, capillaries, or venules.

Referring now to FIG. 1, a balance board 10 in accordance with embodiments of the present disclosure is shown. The balance board 10 includes a platform 20 and one or more balance block(s) 40. In use, a user stands on the balance board 10 with a single leg to train and to improve balance. Specifically, the platform 20 is sized and dimensioned to receive a single foot of a user as opposed to both feet of a user. Balance training on a single leg may translate to natural locomotion more readily than with two leg balance training. The balance board 10 may stimulate a user with both proprioceptively and mechanoreceptively simultaneously to activate more nerves in the foot and leg of the user. The dual stimulation of proprioceptive stimulation and mechanoreceptive stimulation may enhance somatosensory stimulation and may further benefit balance training. Proprioceptive stimulation is provided by micro-wobbles of the balance blocks 40. Mechanoreceptive stimulation is provided by a mechanoreception stimulation surface 30 disposed on the platform 20. The dual stimulation mechanisms may improve a rate of balance training.

Figure 2:
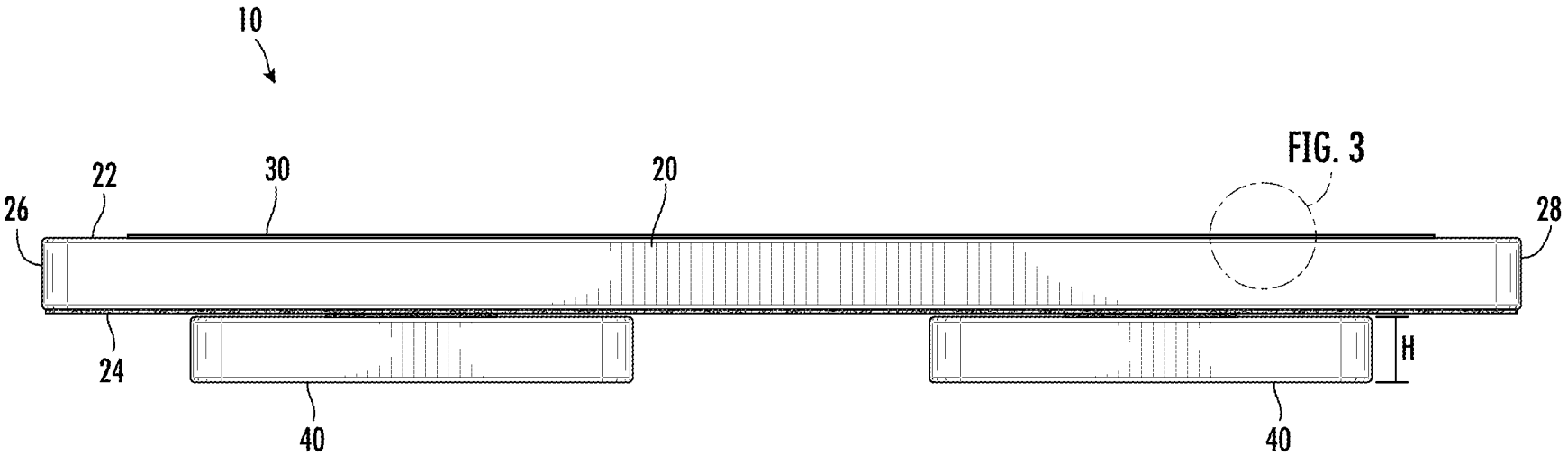
FIG. 2 is a side view of the balance board of FIG. 1.

With additional reference to FIG. 2, the platform 20 has a first side or a top side 22, a second side or a bottom side 24, a first side end 26, and a second side end 28. The top side 22 of the platform 20 is sized and dimensioned to fit a single foot of a user thereon. The platform 20 may have a width in the range of 100 millimeters to 150 millimeters and may have length in the range of 300 millimeters to 380 millimeters. The platform 20 may be substantially rigid such that the platform 20 does not flex under the weight of the user. The user stands on the top side 22 of the platform 20 with a single foot unsecured to the platform 20. For example, the balance board 10 may be used to improve the balance of a user during locomotion without a strap to secure the balance board 10 to the single foot of a user.

The top side 22 includes the mechanoreception stimulation surface 30. The mechanoreception stimulation surface 30 has a plurality of protuberances 32 protruding upwardly from the top side 22. When a user stands on the platform 20, the protuberances 32 mechanoreceptively stimulate the foot of the user. The mechanoreception stimulation surface 30 may increase micro-circulation within the foot of the user. The protuberances 32 may mechanoreceptively stimulate the foot of the user and increase micro-circulation through texture, skin stretching, or pressure. For example, each protuberance 32 may have a peak and that acts as a pressure point on the foot of the user. In some embodiments, a valley is defined between adjacent protuberances 32 to receive the skin of the foot and stretch the skin. The smallest blood vessels of the circulatory system may have little to no smooth muscle surrounding the vessels to circulate blood. The mechanoreception stimulation surface 30 may assist circulation of blood through these smallest blood vessels. To maximize mechanoreceptive stimulation a user may stand on the mechanoreceptive stimulation surface 30 barefoot or with a thin sock or foot covering. The mechanoreception stimulation surface 30 may be made of a rubber ethylene vinylene acetate (RBEVA) material. The mechanoreception stimulation surface 30 may be adhered or otherwise bonded to the top side 22. The mechanoreception stimulation surface 30 may cover only a portion of the top side 22 or may cover the entirety of the top side 22. For example, a portion of the top side 22 may be exposed or uncovered by the mechanoreception stimulation surface 30. The top side 22 may be exposed adjacent to the first side end 26 or the second side end 28. In some embodiments, the top side 22 may be exposed adjacent to the first side end 26 and the second side end 28 as shown in FIG. 1.

Figure 3:
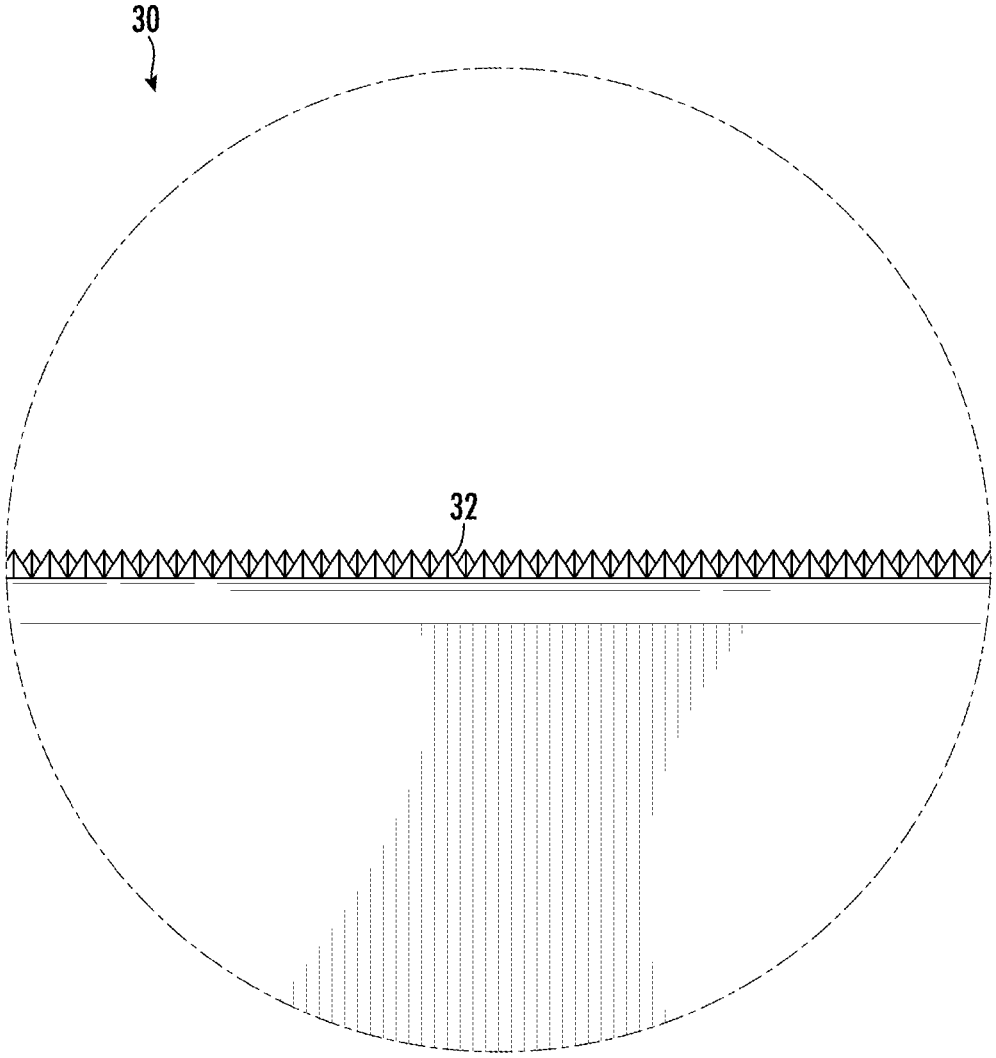
FIG. 3 is an enlarged view of a portion of the balance board as indicated in FIG. 2.

With particular reference to FIG. 3, each protuberance 32 may have a pyramidal profile. In some embodiments, the protuberances 32 have a square base or a triangular base. In certain embodiments, the protuberances 32 are conical and have a circular base. The protuberances 32 may terminate in apex or may be frustopyramidal or frustoconical. The protuberances 32 may have a height in the range of 0.5 millimeters to 2 millimeters, e.g., 1.5 millimeters. The base of the protuberances 32 may have a width in the range of 0.5 millimeters to 4 millimeters, e.g., 2.5 millimeters. The base of the protuberances 32 may be in contact with one another or spaced apart in the range of 0.25 millimeters to 2 millimeters, e.g., 1 millimeter.

Figure 4:
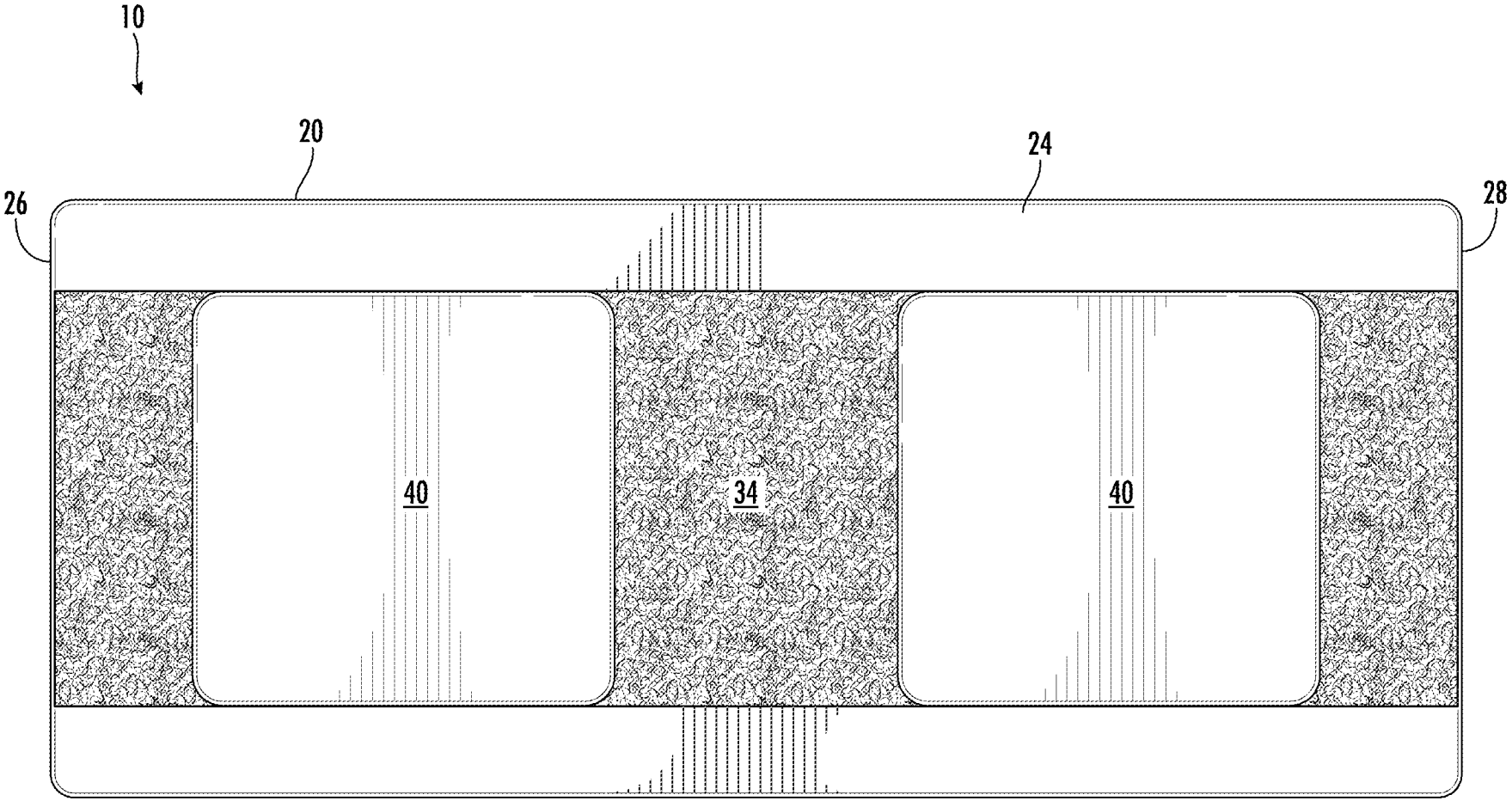
FIG. 4 is a bottom view of the balance board of FIG. 1.
Figure 5:
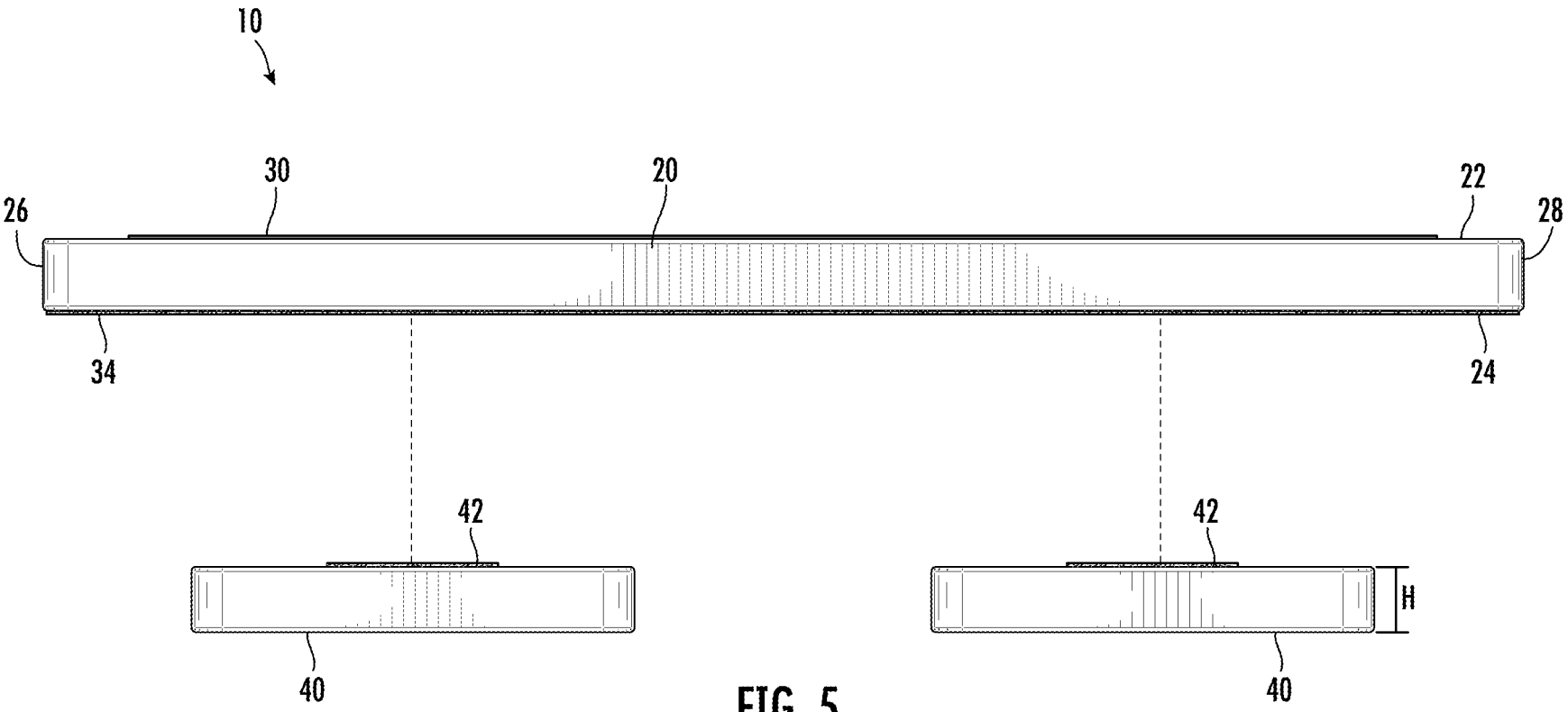
FIG. 5 is an exploded view of the balance board of FIG. 1.

Referring to FIG. 4, the bottom side 24 includes a securement surface 34 for attachment of the balance blocks 40 to the bottom side 24 of the platform 20. The securement surface 34 extends along a length of the bottom side 24 between the first side end 26 and the second side end 28. The securement surface 34 may be the first part or the second part of a two-part fastener, e.g., a hook and loop fastener. The securement surface 34 may cover the entirety of the bottom side 24 or may cover only a portion of the bottom side 24 as shown.

The balance blocks 40 attach to the bottom side 24 of the platform 20 and micro-wobble to proprioceptively stimulate the user. The balance blocks 40 may be made of a semi-rigid material that deforms under the weight of the user standing on the platform 20 of the balance board 10. For example, the balance blocks 40 may be made of an open cell or closed cell foam material. Micro-wobbles may be generated under the weight of the user standing on the platform 20. The micro-wobbles may be a result of muscle imbalances in the foot, ankle, knee, or hip of the user which may cause the balance blocks 40 to deform non-uniformly. The micro-wobbles of the balance blocks 40 may cause the user to adjust or compensate to maintain balance on the balance board 10 thereby training and improving the balance of the user. Each balance block 40 may deform omnidirectionally, 360-degrees, around the perimeter of the balance block 40. The omnidirectional deformation of the balance blocks 40 allow for training balance in each plane or about each axis of movement. For example, deformation of the balance blocks 40 longitudinally along the length of the platform 20 towards the first side end 26 may train plantar flexion or dorsi-flexion and deformation of the balance blocks 40 laterally along the width of the platform 20 may train inversion or eversion of the foot and ankle.

Figure 6:
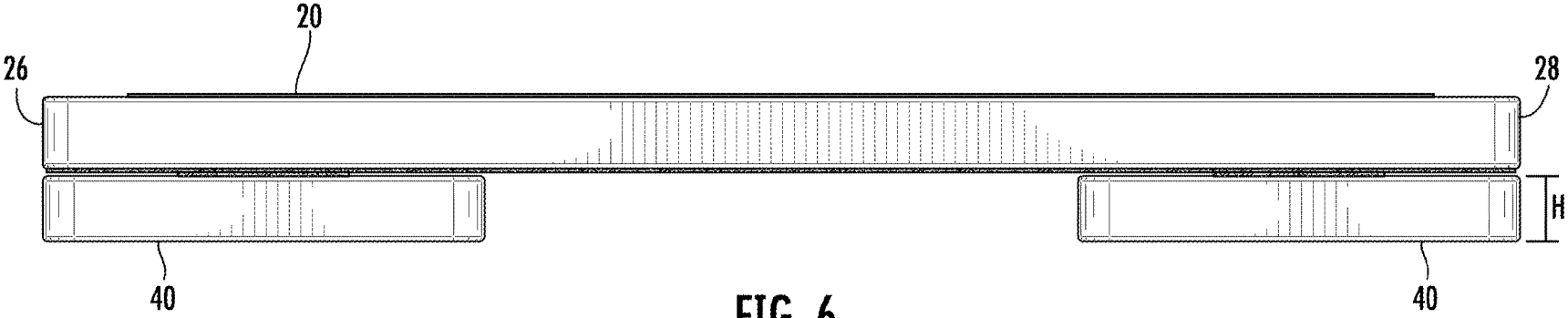
FIG. 6 is a side view of the balance board of FIG. 1 in a first configuration thereof.
Figure 7:
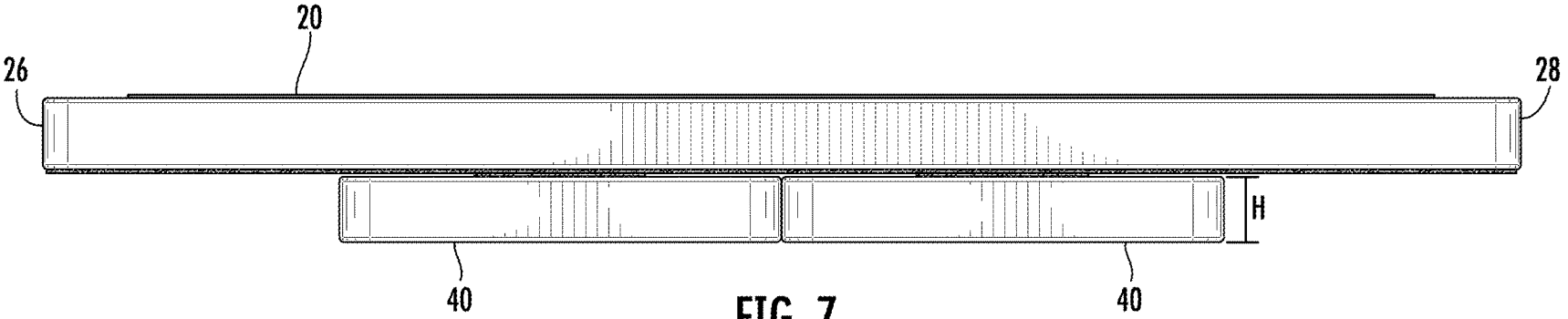
FIG. 7 is a side view of the balance board of FIG. 1 in a second configuration thereof.
Figure 8:
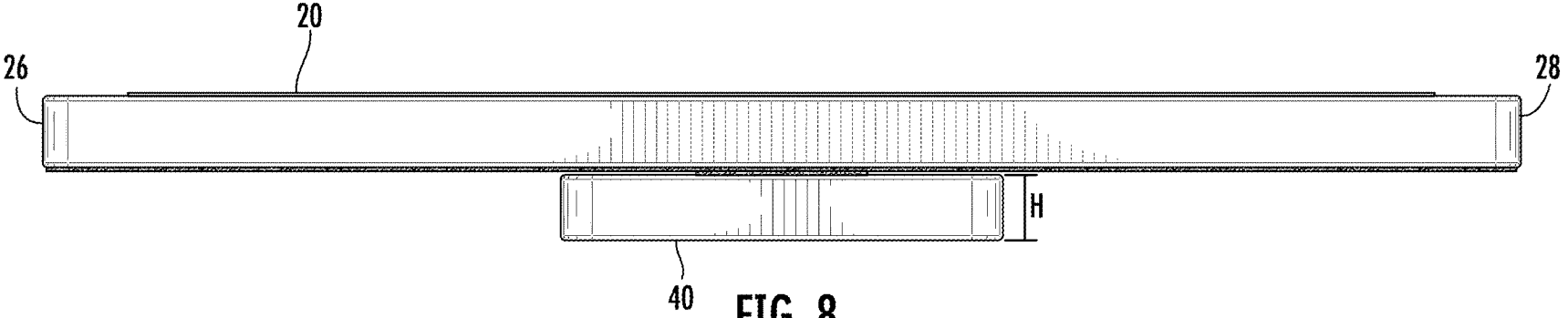
FIG. 8 is a side view of the balance board of FIG. 1 in a third configuration thereof.

With additional reference to FIGS. 5-8. the balance blocks 40 include an attachment surface 42 that cooperates with the securement surface 34. The attachment surface 42 may be the first part or the second part of the two-part fastener, e.g., the hook or the loop of a hook and loop fastener. The balance blocks 40 may secure to the bottom side 24 of the platform 20 at any point along the securement surface 34 between the first and second side ends 26, 28. The balance board 10 may have a plurality of configurations to adjust the difficulty of the balance training. For example, the balance board 10 may have a first or easy configuration, a second or moderate configuration, and a third or difficult configuration. In the easy configuration, a first balance block 40 and a second balance block 40 may be spaced apart and attached adjacent to the first side end 26 and the second side end 28 (FIG. 6). In the moderate configuration, the first and second balance block 40 may be attached centrally or medially along securement surface 34 spaced apart from the first and second side ends 26, 28, and may be adjacent to or in contact with one another (FIG. 7). In the difficult configuration, a single balance block 40 may be attached centrally or medially along the securement surface 34 (FIG. 8). Adjusting the position of the balance blocks 40 may shift the balance point or equilibrium point of the balance board 10.

With particular reference to FIGS. 9-12, the balance blocks 40 may be formed in a variety sizes and shapes to further adjust the difficulty of balance training. The balance blocks 40 may have a rectangular or square profile or base. The balance blocks 40 have a height H in the range of 10 millimeter to 60 millimeters. The greater the height H of the balance blocks 40 the higher the center of gravity of the balance board 10 is positioned and, thus, the more difficult the balance training. In some embodiments, the balance blocks 40 have a semi-cylindrical profile. The semi-cylindrical profile may be a half a cylinder or may be less than half of a cylinder. For example, the semi-cylindrical profile may be taken along the diameter of a cylinder or may be taken along a chord of a cylinder. In such embodiments, the balance blocks 40 may roll in addition to or alternatively to micro-wobbling to increase the difficulty of the balance training. When a balance block 40 having a semi-cylindrical profile is attached to the platform 20 a central longitudinal axis of the balance block 40 may be parallel to a central longitudinal axis or the bottom side 24 of the platform 20.

In certain embodiments, the balance board 10 may be configured to train and improve stability of the upper body. For example, a user may perform planks or push-ups on one or more balance boards 10 to train stability of the hands, wrist, elbow, and shoulder. In such embodiments, the platform 20 may be sized and dimensioned to fit a hand or both hands of user thereon.

Figure 9:
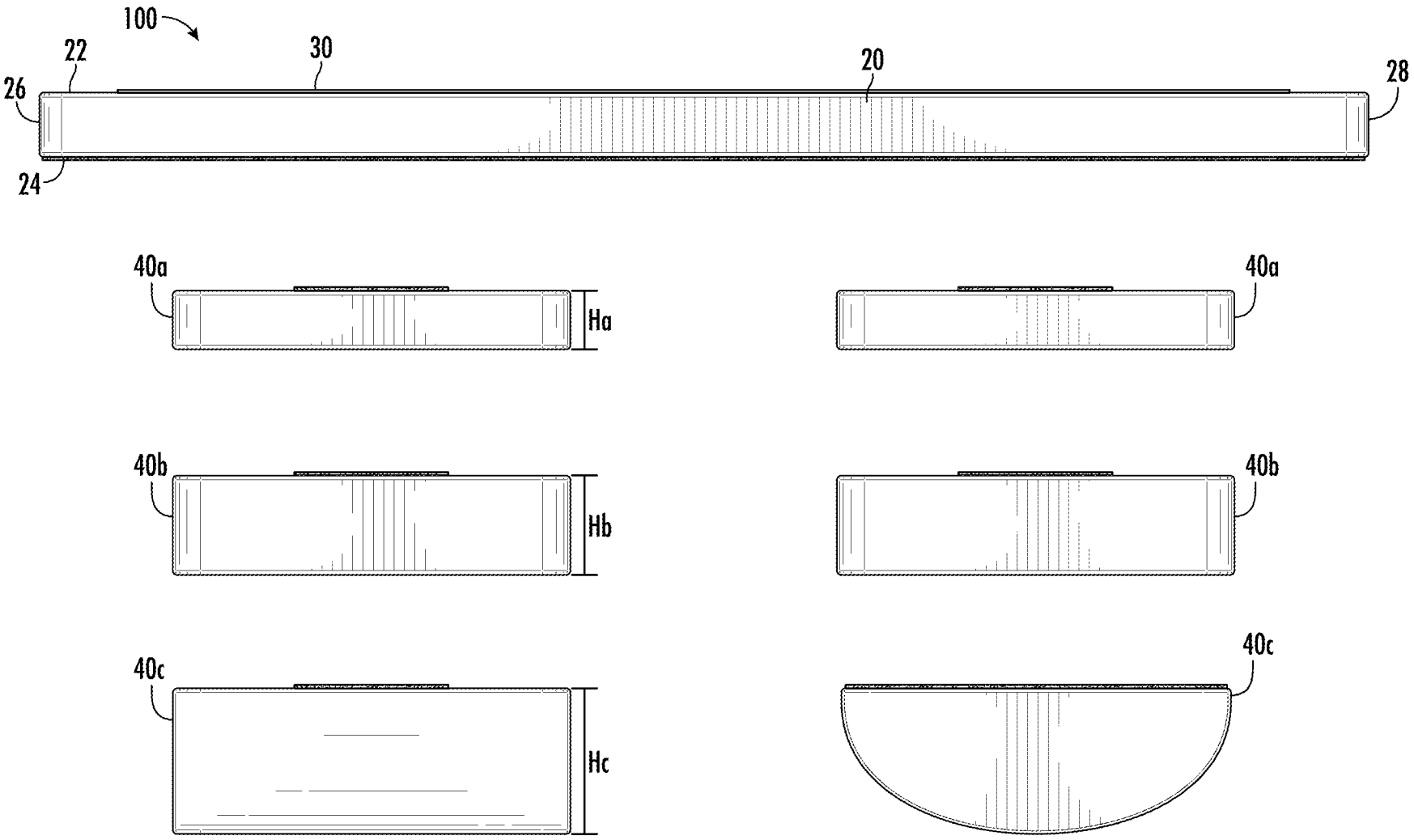
FIG. 9 is a side view of a balance trainer kit in accordance with embodiments of the present disclosure.
Figure 10:
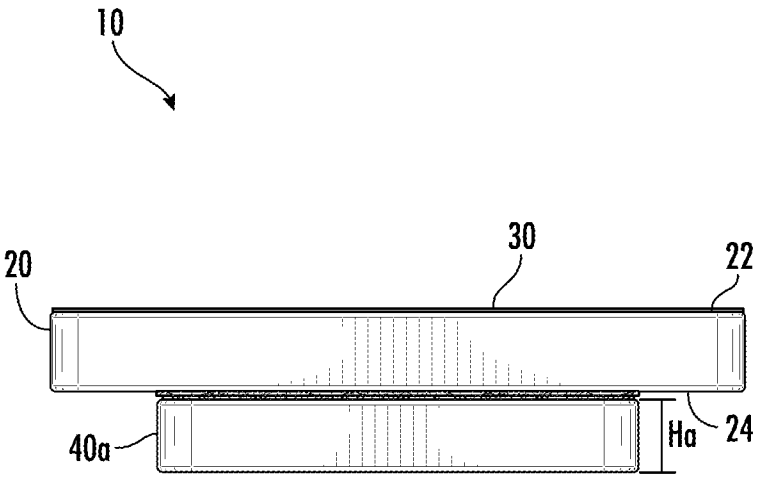
FIG. 10 is an end view of a balance board in accordance with embodiments of the present disclosure in a first composition thereof.
Figure 11:
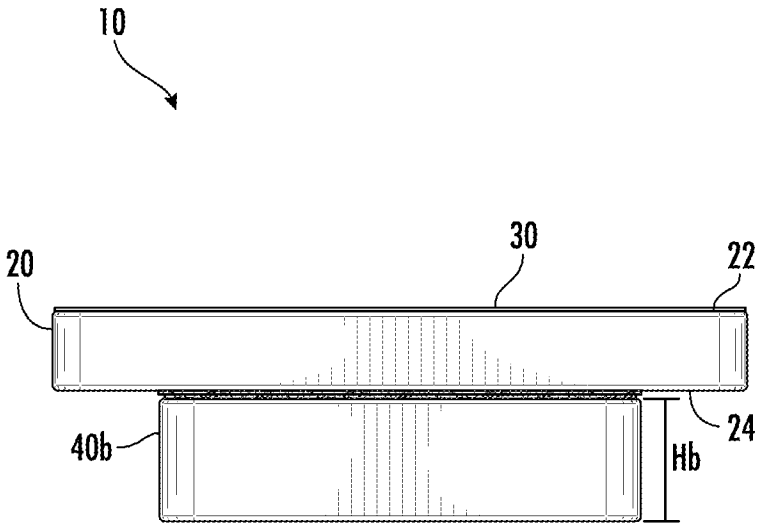
FIG. 11 is an end view of a balance board in accordance with embodiments of the present disclosure in a second composition thereof.
Figure 12:
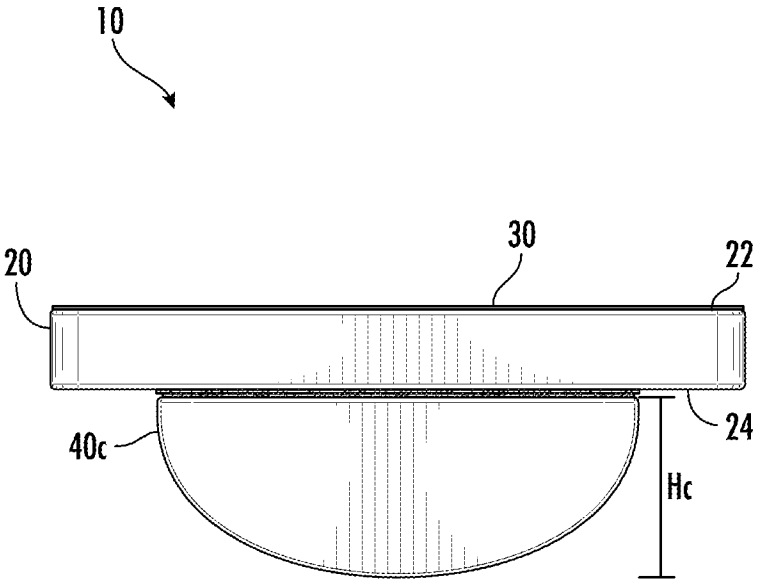
FIG. 12 is an end view of a balance board in accordance with embodiments of the present disclosure in a third composition thereof.

With specific reference to FIG. 9, a balance trainer kit 100 may include a platform 20 and a plurality of balance blocks 40*a*, 40*b*, 40*c* to compose the balance board 10 into a first or beginner composition, a second or intermediate composition, and a third or advanced composition. In the beginner composition (FIG. 10), the balance blocks 40*a* are attached to the platform 20. The balance blocks 40*a* may have the shortest height H of the plurality of balance blocks 40*a*, 40*b*, 40*c*. The balance blocks 40*a* may have a height Ha in the range of 10 millimeters to 30 millimeters, e.g., 25 millimeters. In the intermediate composition (FIG. 11), the balance blocks 40*b* may be attached to the platform 20 and may have the tallest height H of the plurality of balance blocks 40*a*, 40*b*, 40*c*. The balance block 40*b* may have a height Hb in the range of 30 millimeters to 60 millimeters, e.g., 50 millimeters. In the advanced composition (FIG. 12), the balance block 40*c* may be attached to the platform 20 and may have a semi-cylindrical profile. The balance block 40*c* may have a height Hc in the range of 20 millimeters to 50 millimeters, e.g., 35 millimeters.

The balance board 10 may be composed in any one of the beginner composition, intermediate composition, or advanced composition and may be configured into anyone of the easy configuration, the moderate configuration, or the difficult configuration. For example, the balance board 10 may be in the intermediate composition with the balance blocks 40*b* attached to the platform 20 and the easy configuration with the balance blocks 40*b* attached adjacent to the first side end 26 and the second side end 28. In embodiments, the balance board 10 may be in the beginner composition and the difficult configuration with a single balance block 40*a* attached to platform 20 centrally along the securement surface 34. In certain embodiments, the balance board 10 may be in the advanced composition and the moderate configuration with the balance blocks 40*c* attached to the platform 20 spaced apart from the first side end 26 and the second side end 28.

Figure 13:
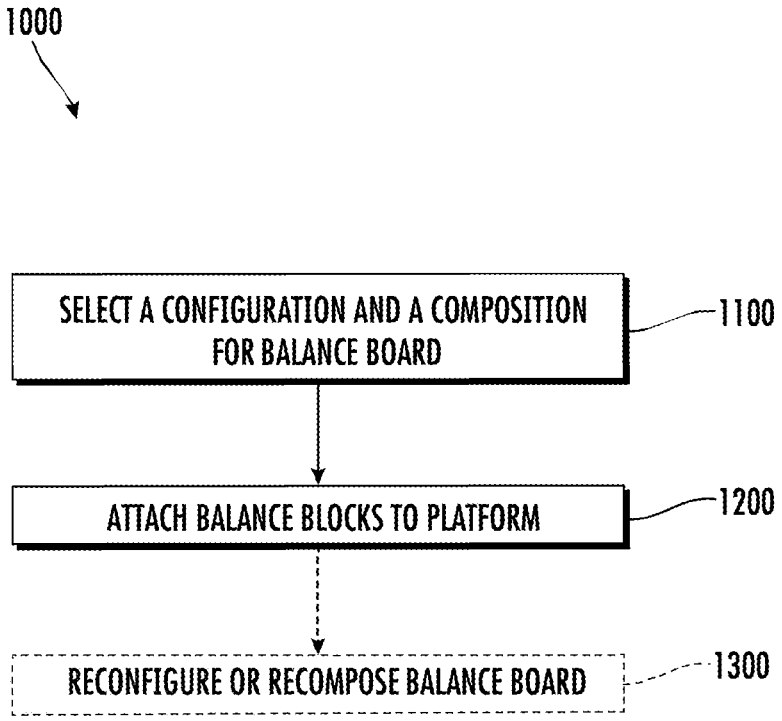
FIG. 13 is a flowchart illustrating a method of assembling a balance board in accordance with embodiments of the present disclosure.

With reference to FIG. 13, a method 1000 of assembling a balance board in accordance with the present disclosure is described with reference to the balance board 10 of FIGS. 1-12. Assembling the balance board 10 includes selecting a configuration and a composition for the balance board 10 (Step 1100). The configuration of the balance board 10 may be one of the easy configuration, the moderate configuration, or the difficult configuration described above. The configuration of the balance board 10 refers to the number and the position of the balance blocks 40 attached to the bottom side 24 of the platform 20. The composition of the balance board 10 may be one of the beginner composition, the intermediate composition, or the advanced composition described above. The composition of the balance board 10 refers to the type of balance block 40, e.g., the balance block 40*a*, 40*b*, 40*c*, attached to the bottom side 24 of the platform 20.

The balance blocks 40 are attached to the bottom side 24 of the platform 20 to assemble the balance board 10 in the selected configuration and composition (Step 1200). The balance blocks 40 are attached through cooperation between the securement surface 34 and the attachment surface 42. In embodiments, the securement surface 34 is the loop half of a hook and loop fastener and the attachment surface 42 is the hook half of the hook and loop fastener. In such embodiments, the balance blocks 40 are positioned along the securement surface 34 and pressed to attach the balance blocks 40 in the selected configuration with the selected composition.

The balance board 10 may be reconfigured or recomposed into another configuration or composition (Step 1300). The other configuration or composition may be a different one of the easy configuration, the moderate configuration, or the difficult configuration or a different one of the beginner composition, the intermediate composition, or the advanced composition. For example, a balance board 10 in the easy configuration and the beginner composition may be reconfigured into the moderate configuration by removing the balance blocks 40*a* and reattaching the balance blocks 40*a* centrally or medially along securement surface 34 spaced apart from the first and second side ends 26, 28, and may be adjacent one another. The balance board 10 would then be in the moderated configuration and the beginner composition.

Although the method steps are described in a specific order, it should be understood that other steps may be performed in between described steps, described steps may be adjusted so that they occur at slightly different times, or the described steps may occur in any order unless otherwise specified.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A balance board comprising:

a platform having a top side and a bottom side opposite the top side, the platform sized and dimensioned to receive only a single foot of a user thereon, the top side of the platform includes a mechanoreception stimulation surface configured to mechanoreceptively stimulate neurons within cutaneous skin of the user; and a first balance block removably attached to the bottom side of the platform, the first balance block selectively attachable to the bottom side of the platform at any position between a first side end of the platform and a second side end of the platform, opposite the first side end of the platform, the first balance block configured to proprioceptively stimulate neurons within muscles, tendons, or joints of the user.

2. The balance board according to claim 1, wherein the top side is configured to receive the single foot of the user in an unsecured manner.

3. The balance board according to claim 1, wherein the mechanoreception stimulation surface comprises a plurality of protuberances projecting away from the top side of the platform.

4. The balance board according to claim 1, wherein the first balance block is configured to micro-wobble under the weight of a user to proprioceptively stimulate neurons of the user.

5. The balance board according to claim 4, wherein the first balance block is configured to micro-wobble omnidirectionally around a perimeter thereof to improve balance of the user in each plane or axis of movement.

6. The balance board according to claim 1, further comprising a second balance block removably attached to the bottom side of the platform, the second balance block sized and dimensioned similar to the first balance block.

7. The balance board according to claim 6, wherein the balance board has:

a first configuration in which the first balance block is disposed adjacent to a first side end of the platform and the second balance block is disposed adjacent to a second side end of the platform opposite the first side end, the second balance block spaced apart from the first balance block; and a second configuration in which the first balance block is spaced apart from the first side end and the second balance block is spaced apart from the second side end, the balance board configured to provide more proprioceptive stimulation when in the second configuration than when in the first configuration.

8. A balance board comprising:

a platform having a textured first side and a second side opposite the textured first side, the second side including a first part of a two-part fastener, the platform sized and dimensioned to receive a single foot of a user thereon, the textured first side configured to mechanoreceptively stimulate the user; and a first balance block including a second part of the two-part fastener, the first balance block removably attached to the second side of the platform, the first balance block configured to deform omnidirectionally around a perimeter thereof to proprioceptively stimulate the user.

9. The balance board according to claim 8, wherein the textured first side comprises a plurality of protuberances projecting upwardly therefrom.

10. The balance board according to claim 8, wherein deformation of the first balance block occurs under the weight of the user such that the proprioceptive stimulation of the user thereby improves balance of the user in each plane or axis of movement.

11. The balance board according to claim 7, wherein the balance board is configured to improve balance of the user with the single foot of the user unsecured to the platform.

12. A balance trainer kit comprising:

a balance board according to claim 8; and a plurality of balance blocks attachable to the platform such that the balance board is configurable into a first configuration, a second configuration, and a third configuration and is composable into a first composition and a second composition.

13. A balance board comprising:

a platform having a top side and a bottom side opposite the top side, the top side including mechanoreception stimulation surface, the bottom side including a securement surface extending along a length of the bottom side between a first side end of the platform and a second side end opposite the first side end, the securement surface being a first part of a two-part fastener; and a first balance block removably attached to the bottom side of the platform and positionable at any position between the first side end and the second side end, the first balance block including an attachment surface mateable with the securement surface to attach the first balance block to the platform, the attachment surface being the second part of the two-part fastener.

14. The balance board according to claim 13, wherein the first balance block has a rectangular profile.

15. The balance board according to claim 14, wherein the first balance block has a height in the range of 10 millimeters to 60 millimeters.

16. The balance board according to claim 13, wherein the first balance block has semi-cylindrical profile.

17. The balance board according to claim 13, comprising a second balance block removably attached to the bottom side of the platform and positionable between the first side end and the second side end.

18. The balance board according to claim 17, wherein the balance board has a first configuration in which the first balance block is disposed adjacent to the first side end and the second balance block is disposed adjacent to the second side end and spaced apart from the first balance block and a second configuration in which the first balance block is spaced apart from the first side end and the second balance block is spaced apart from the second side end.

19. A method of assembling a balance board comprising:

selecting a configuration and a composition for the balance board from one of a first configuration, a second configuration, or a third configuration and a first composition, a second composition, or a third composition; and attaching balance blocks to a platform of the balance board such that the balance board is in the selected configuration and has the selected composition, the platform including a securement surface that is a first part of a two-part fastener, the balance blocks including an attachment surface including a second part of the two-part fastener, the balance blocks attached to the platform at any position between a first side end of the platform and a second side end of the platform, opposite the first side end of the platform, by mating the attachment surface and the securement surface.

20. The method according to claim 19, comprising reconfiguring the balance board into a different configuration of the first configuration, the second configuration, or the third configuration.

21. The method according to claim 19, comprising recomposing the balance board into a different composition of the first composition, the second composition, or the third composition.

22. The balance board according to claim 1, wherein the platform has a width in a range 100 millimeters to 150 millimeter and a length in a range of 300 millimeters to 380 millimeters.

23. The balance board according to claim 13, wherein the platform has a first side edge and a second side edge opposite the first side edge, the first side edge and the second side edge extending between the first side end and the second side end, the securement surface of the platform spaced apart from the first side edge and the second side edge such that less than the entire bottom surface is covered by the securement surface.

* * * * *